US011242736B2

(12) United States Patent
Tao et al.

(10) Patent No.: US 11,242,736 B2
(45) Date of Patent: Feb. 8, 2022

(54) FRACTURING DEVICE FOR EXTRACTION OF COALBED METHANE IN LOW PERMEABILITY RESERVOIR

(71) Applicant: China University of Geosciences (Beijing), Beijing (CN)

(72) Inventors: Shu Tao, Beijing (CN); Dazhen Tang, Beijing (CN); Hao Xu, Beijing (CN); Song Li, Beijing (CN); Shida Chen, Beijing (CN)

(73) Assignee: China University of Geosciences (Beijing), Beijing (CN)

( * ) Notice: Subject to any disclaimer, the term of this patent is extended or adjusted under 35 U.S.C. 154(b) by 34 days.

(21) Appl. No.: 16/740,446

(22) Filed: Jan. 12, 2020

(65) Prior Publication Data

US 2021/0172304 A1 Jun. 10, 2021

(30) Foreign Application Priority Data

Dec. 6, 2019 (CN) ..... 201911254336.X

(51) Int. Cl.

| | |
|---|---|
| ***E21B 43/26*** | (2006.01) |
| ***E21B 33/124*** | (2006.01) |
| ***E21B 43/12*** | (2006.01) |
| ***E21B 43/00*** | (2006.01) |
| *E21B 33/128* | (2006.01) |

(52) U.S. Cl.

CPC ..... *E21B 43/26* (2013.01); *E21B 33/1243* (2013.01); *E21B 43/006* (2013.01); *E21B 43/13* (2020.05); *E21B 33/1285* (2013.01)

(58) Field of Classification Search

CPC ..... E21B 43/006; E21B 43/13; E21B 43/26; E21B 33/1243; E21B 33/1285

See application file for complete search history.

(56) References Cited

U.S. PATENT DOCUMENTS

2015/0007988 A1* 1/2015 Ayasse ..... E21B 17/046 166/271

* cited by examiner

*Primary Examiner* — Yong-Suk (Philip) Ro
(74) *Attorney, Agent, or Firm* — W&KIP

(57) ABSTRACT

Disclosed is a fracturing device for extraction of coalbed methane in low permeability reservoir. In the disclosure, by controlling the fracturing of fracturing pipes and the sealing of a segmented sealing mechanism for fracturing using a fracturing controller, the fracturing in fracturing holes can be effectively controlled. The segmented sealing mechanism for fracturing in the disclosure can separate each of the fracturing pipes in the fracturing holes separately in a sealed manner respectively, and perform segmented fracturing operations using each of the fracturing pipes, so as to effectively improve the uniformity and thoroughness of fracturing and ensure fracturing ability. In the disclosure, when the sealing operations are performed in each segment, the sealing effect of each segment can be ensured, and the sealing efficiency can be ensured, so that the fracturing ability of each segment of fracturing is improved to ensure the fracturing effect.

9 Claims, 6 Drawing Sheets

FRACTURING DEVICE FOR EXTRACTION OF COALBED METHANE IN LOW PERMEABILITY RESERVOIR

CROSS-REFERENCE TO RELATED APPLICATIONS

This application claims priority to Chinese Patent Application No. 201911254336.X with a filing date of Dec. 6, 2019. The content of the aforementioned application, including any intervening amendments thereto, are incorporated herein by reference.

TECHNICAL FIELD

The present disclosure relates to a fracturing apparatus, in particular, to a fracturing device for extraction of coalbed methane in low permeability reservoir.

BACKGROUND ART

Currently, for coalbed in the low permeability reservoir, during extraction of the coalbed methane, usually a special fracturing apparatus is used to perform fracturing operations for the coalbed, so as to make the permeability in the coalbed reach a required value and facilitate the release of the coalbed methane. The existing fracturing apparatus generally perform fracturing operations on the whole fracturing holes at the same time. Although, this fracturing method is simple, it is difficult to achieve better results during fracturing due to the longer fracturing holes, and the problem of uneven fracturing is prone to occur during fracturing if there is a lot of voids or air leaks in a part during fracturing, so that it is still difficult to achieve good fracturing for low permeability locations, and the fracturing is more serious for locations with larger voids, which leads to unbalanced fracturing and difficulty in achieving fracturing equilibrium.

Therefore, the present disclosure provides a fracturing device for extraction of coalbed methane in low permeability reservoir, so as to solve the problems in the background.

SUMMARY OF THE INVENTION

An object of the present disclosure is to provide a fracturing device for extraction of coalbed methane in low permeability reservoir, so as to solve the problems in the background.

To this end, the present invention provides the following technical solutions.

A fracturing device for extraction of coalbed methane in low permeability reservoir includes a feeding mechanism for fracturing pipe, a plurality of fracturing pipes, a plurality of segmented sealing mechanisms for fracturing and a fracturing controller, wherein the adjacent two fracturing pipes are fixed coaxially by using the segmented sealing mechanisms for fracturing, the feeding mechanism for fracturing pipe feeds each of the fracturing pipes into fracturing holes of the coalbed methane, and the fracturing controller may control the fracturing of the fracturing pipes and the sealing of the segmented sealing mechanisms for fracturing so as to control the fracturing in the fracturing holes, and wherein the segmented sealing mechanisms for fracturing may separate each of the fracturing pipes in the fracturing holes separately in a sealed manner respectively so as to perform segmented fracturing operations using each of the fracturing pipes.

Further, preferably, each of the segmented sealing mechanisms for fracturing comprises a front sealing seat, a rear sealing seat, a front expansion sealing ring and a rear expansion sealing ring, wherein the front sealing seat is coaxially fixedly connected to the rear sealing seat, and ends of the front sealing seat and the rear sealing seat are connected to the respective fracturing pipe; both the front sealing seat and the rear sealing seat are provided with a reception annular groove, the reception annular groove of the front sealing seat is sleeved inside with the front expansion sealing ring, the reception annular groove of the rear sealing seat is sleeved inside with the rear expansion sealing ring, and expansions of the front expansion sealing ring and the rear expansion sealing ring are controlled by the fracturing controller.

Further, preferably, before the front expansion sealing ring and the rear expansion sealing ring do not expand, outer peripheral surfaces of the front expansion sealing ring and the rear expansion sealing ring are lower than a notch surface of the reception annular groove, and after the front expansion sealing ring and the rear expansion sealing ring expand, the outer peripheral surfaces may abut against inner walls of the fracturing holes.

Further, preferably, a sealing fluid outflow hole for a sealing fluid to flow out is disposed between the front expansion sealing ring and the rear expansion sealing ring, the sealing fluid outflow hole is arranged on the front sealing seat and/or the rear sealing seat, and a sealing fluid outflow hole is provided inside with a pressure valve; the pressure valve is configured such that the pressure valve allows the sealing fluid to outflow into a sealing cavity surrounded by the front expansion sealing ring, the rear expansion sealing ring and the inner walls of the fracturing holes only when the sealing fluid in the sealing fluid outflow hole reaches a certain pressure value.

Further, preferably, the pressure value is configured such that the pressure valve allows the sealing fluid to outflow into the sealing cavity surrounded by the front expansion sealing ring, the rear expansion sealing ring and the inner walls of the fracturing holes only when the front expansion sealing ring and the rear expansion sealing ring expand to a certain degree.

Further, preferably, the front sealing seat is welded to the rear sealing seat, and a cavity is disposed where the front sealing seat is welded to the rear sealing seat; the front sealing sea and the rear sealing seat are provided with sealing controlling holes arranged coaxially and communicating with the front expansion sealing ring and the rear expansion sealing ring, respectively, and the front expansion sealing ring and the rear expansion sealing ring communicate with the cavity through a communication channel, respectively, so that the sealing liquid may sequentially flow from the sealing controlling holes to the front expansion sealing ring, the communication channel, the cavity, the communication channel and the rear expansion sealing ring, and outflowed by the sealing controlling holes at the rear expansion sealing ring.

Further, preferably, the sealing controlling holes are connected with communication pipes, and centers between the front sealing seat and the rear sealing seat are also connected by a connecting post; an end of the connecting post is limited on a connecting ring in the cavity by a limiting member, and the connecting ring is provided axially with an axial communication hole; the sealing liquid outflow hole is communicated to the cavity and extends in a radial direction along the front sealing seat or the rear sealing seat.

Further, preferably, the feeding mechanism for fracturing pipe includes a feeding drive block, a support, a feeding post, and a positioning assembly, wherein an output end of the feeding drive block is connected to the feeding post, and a lower end of the feeding post is tightly connected to the fracturing pipe; one side of the feeding drive block is provided with the support, and the support is further provided with the positioning assembly; the fracturing pipe is disposed through the positioning assembly, and the fracturing pipe may be disposed for a fine adjustment angle in the positioning assembly.

Further, preferably, the positioning assembly comprises a positioning shoulder seat, a positioning sleeve, a ball hinge, a connecting member, and a sleeve card, wherein the positioning shoulder seat is fixed on the support, the positioning sleeve is sleeved on the positioning shoulder seat, and the positioning sleeve is provided inside with a through hole; an end of the positioning sleeve is further connected with the ball hinge capable of finely adjusting the angle, the ball hinge is also provided with the through hole, and an end face of the ball hinge is connected to the sleeve card by the connecting member.

Further, preferably, the sealing liquid is a quick-setting expansion sealing slurry, and the fracturing pipe is provided inside with a fracturing liquid supply hole or the fracturing pipe adopts an automatically controlled liquid-phase carbon dioxide fracturing device.

Compared with the prior art, the present invention has the following beneficial effects:

In the disclosure, by controlling the fracturing of fracturing pipes and the sealing of a segmented sealing mechanism for fracturing using a fracturing controller, the fracturing in fracturing holes can be effectively controlled. The segmented sealing mechanism for fracturing in the disclosure can separate each of the fracturing pipes in the fracturing holes separately in a sealed manner respectively, and perform segmented fracturing operations using each of the fracturing pipes, so as to effectively improve the uniformity and thoroughness of fracturing and ensure fracturing ability. In the disclosure, when the sealing operations are performed in each segment, the sealing effect of each segment can be ensured, and the sealing efficiency can be ensured, so that the fracturing ability of each segment of fracturing is improved to ensure the fracturing effect.

DETAILED DESCRIPTION OF THE EMBODIMENTS

Figure 1:
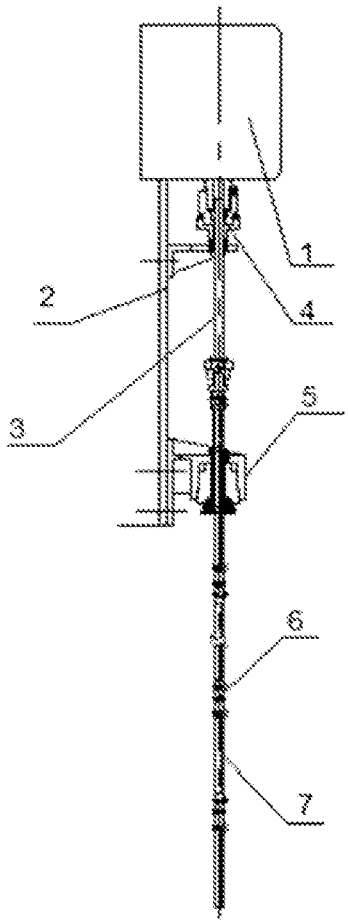
FIG. 1 is a diagram of overall appearance of a fracturing device for extraction of coalbed methane in low permeability reservoir.
Figure 2:
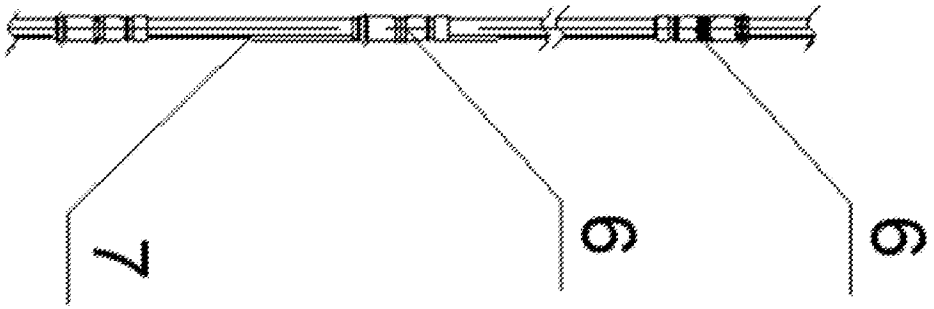
FIG. 2 is a structural diagram showing connection between fracturing pipes and a segmented sealing mechanisms for fracturing of a fracturing device for extraction of coalbed methane in low permeability reservoir.
Figure 3:
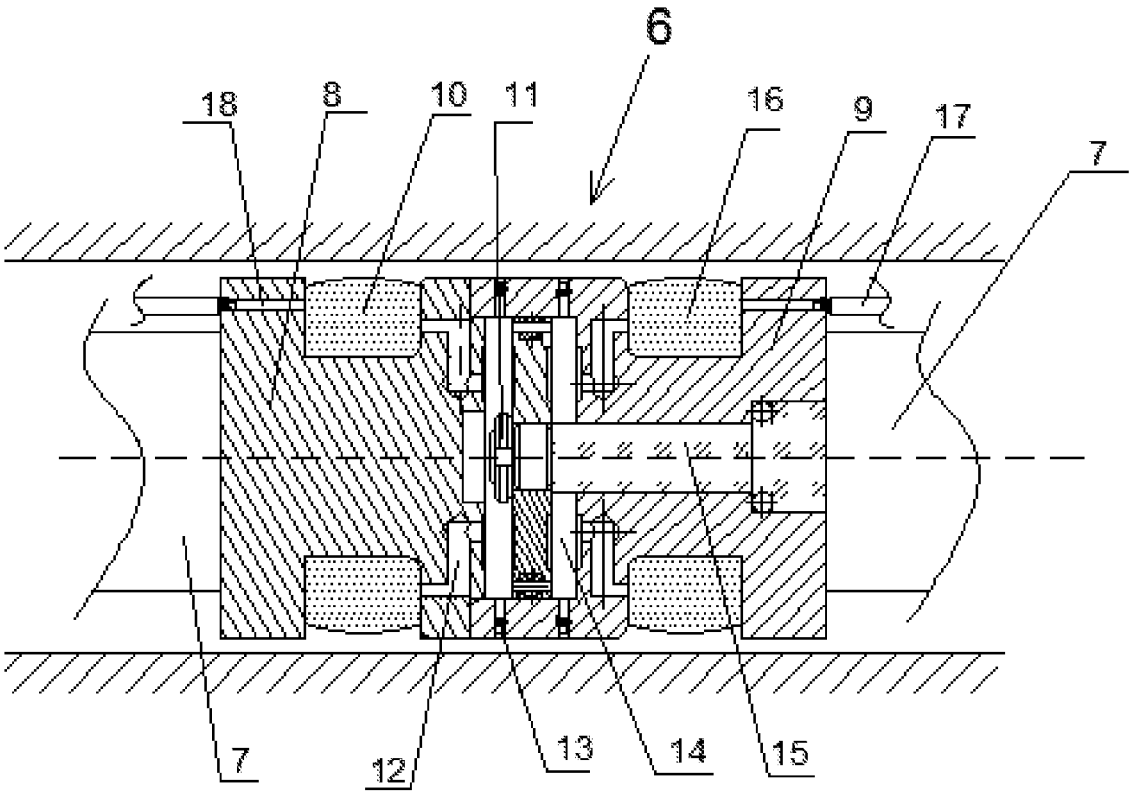
FIG. 3 is a diagram of an internal structure of a segmented sealing mechanisms for fracturing of a fracturing device for extraction of coalbed methane in low permeability reservoir.
Figure 4:
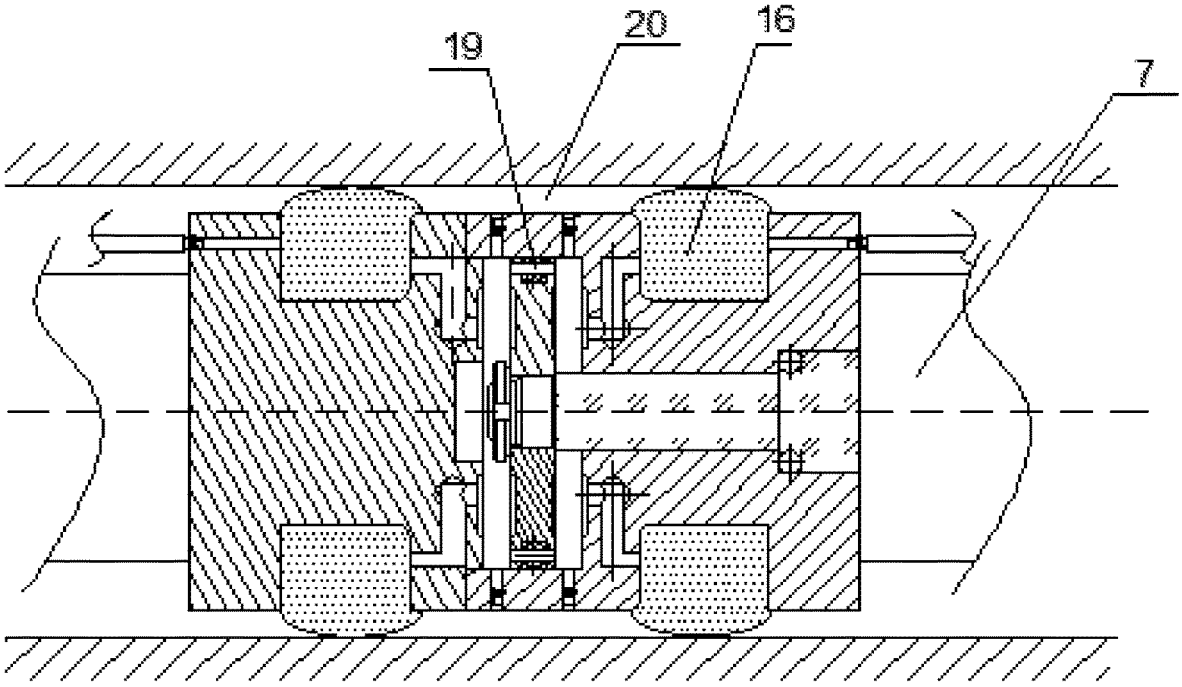
FIG. 4 is a structural diagram of a front expansion sealing ring and a rear expansion sealing ring of a segmented sealing mechanisms for fracturing of a fracturing device for extraction of coalbed methane in low permeability reservoir after expansion.
Figure 5:
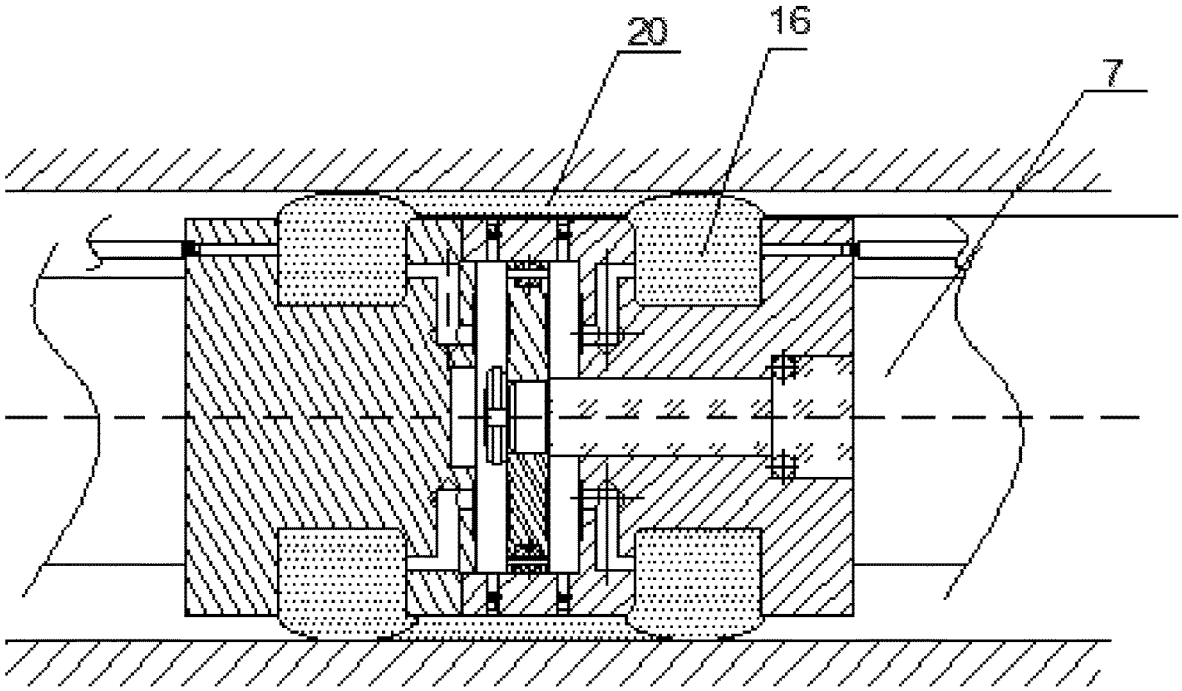
FIG. 5 is a structural diagram of a front expansion sealing ring and a rear expansion sealing ring of a segmented sealing mechanisms for fracturing of a fracturing device for extraction of coalbed methane in low permeability reservoir after expansion and injection of a sealing liquid therebetween.
Figure 6:
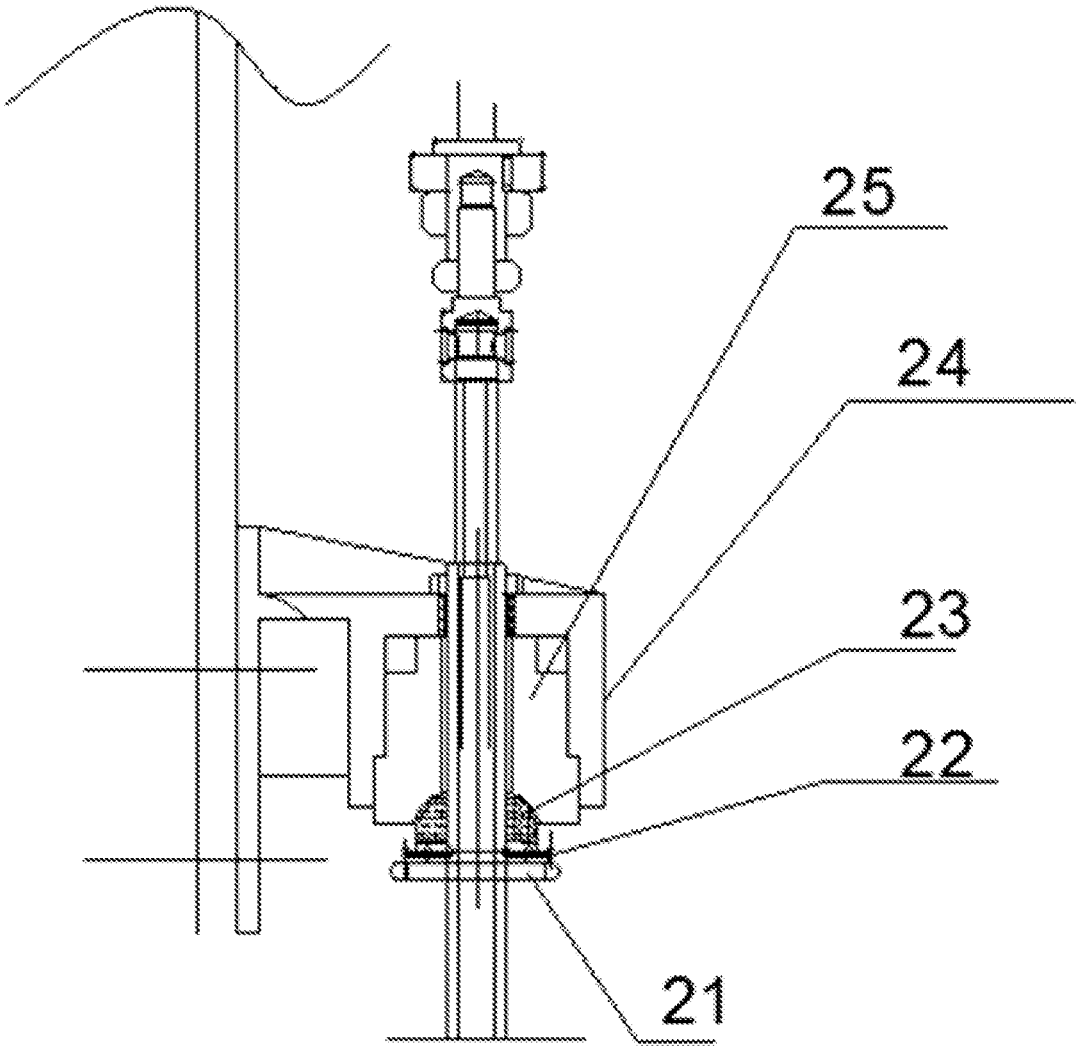
FIG. 6 is a partial structural diagram of a feeding mechanism for fracturing pipe of a fracturing device for extraction of coalbed methane in low permeability reservoir.

With reference to FIGS. 1 to 6, in an embodiment of the present disclosure, a fracturing device for extraction of coalbed methane in low permeability reservoir includes a feeding mechanism for fracturing pipe, a plurality of fracturing pipes 7, a plurality of segmented sealing mechanisms for fracturing 6 and a fracturing controller, wherein the adjacent two fracturing pipes 7 are fixed coaxially by using the segmented sealing mechanisms for fracturing 6, the feeding mechanism for fracturing pipe feeds each of the fracturing pipes 7 into fracturing holes of the coalbed methane, and the fracturing controller may control the fracturing of the fracturing pipes 7 and the sealing of the segmented sealing mechanisms for fracturing 6 so as to control the fracturing in the fracturing holes, and wherein the segmented sealing mechanisms for fracturing 6 may separate each of the fracturing pipes 7 in the fracturing holes separately in a sealed manner respectively so as to perform segmented fracturing operations using each of the fracturing pipes.

In the present embodiment, each of the segmented sealing mechanisms 6 for fracturing includes a front sealing seat 8, a rear sealing seat 9, a front expansion sealing ring 10 and a rear expansion sealing ring 16, wherein the front sealing seat 8 is coaxially fixedly connected to the rear sealing seat 9, and ends of the front sealing seat 8 and the rear sealing seat 9 are connected to the respective fracturing pipe 7; both the front sealing seat 8 and the rear sealing seat 9 are provided with a reception annular groove, the reception annular groove of the front sealing seat 8 is sleeved inside with the front expansion sealing ring 10, the reception annular groove of the rear sealing seat 9 is sleeved inside with the rear expansion sealing ring 16, and expansions of the front expansion sealing ring 10 and the rear expansion sealing ring 16 are controlled by the fracturing controller.

Among them, before the front expansion sealing ring 10 and the rear expansion sealing ring 16 do not expand, outer peripheral surfaces of the front expansion sealing ring 10 and the rear expansion sealing ring 16 are lower than a notch surface of the reception annular groove, and after the front expansion sealing ring 10 and the rear expansion sealing ring 16 expand, the outer peripheral surfaces may abut against inner walls of the fracturing holes.

As a preferred embodiment, a sealing fluid outflow hole 13 for a sealing fluid to flow out is disposed between the front expansion sealing ring 10 and the rear expansion sealing ring 16, the sealing fluid outflow hole 13 is arranged on the front sealing seat 8 and/or the rear sealing seat 9, and a sealing fluid outflow hole 13 is provided inside with a pressure valve; the pressure valve is configured such that the pressure valve allows the sealing fluid to outflow into a sealing cavity 20 surrounded by the front expansion sealing ring 10, the rear expansion sealing ring 16 and the inner walls of the fracturing holes only when the sealing fluid in the sealing fluid outflow hole 13 reaches a certain pressure value.

In the present disclosure, the pressure value is configured such that the pressure valve allows the sealing fluid to outflow into the sealing cavity 20 surrounded by the front expansion sealing ring 10, the rear expansion sealing ring 16 and the inner walls of the fracturing holes only when the front expansion sealing ring 10 and the rear expansion sealing ring 16 expand to a certain degree.

The front sealing seat 8 is welded to the rear sealing seat 9, and a cavity 14 is disposed where the front sealing seat is welded to the rear sealing seat; the front sealing seat 8 and the rear sealing seat 9 are provided with sealing controlling holes 18 arranged coaxially and communicating with the front expansion sealing ring 10 and the rear expansion sealing ring 16, respectively, and the front expansion sealing ring 10 and the rear expansion sealing ring 16 communicate with the cavity through a communication channel 12, respectively, so that the sealing liquid may sequentially flow from the sealing controlling holes 18 to the front expansion sealing ring 10, the communication channel 12, the cavity, the communication channel 12 and the rear expansion sealing ring 16, and outflowed by the sealing controlling holes 18 at the rear expansion sealing ring 16.

The sealing controlling holes 18 are connected with communication pipes 17, and centers between the front sealing seat 8 and the rear sealing seat 9 are also connected by a connecting post 15; an end of the connecting post is limited on a connecting ring in the cavity by a limiting member 11, and the connecting ring is provided axially with an axial communication hole 19; the sealing liquid outflow hole 13 is communicated to the cavity 14 and extends in a radial direction along the front sealing seat 8 or the rear sealing seat 9.

The feeding mechanism for fracturing pipe includes a feeding drive block 1, a support 2, a feeding post 3, and a positioning assembly 5, wherein an output end of the feeding drive block 1 is connected to the feeding post, and a lower end of the feeding post is tightly connected to the fracturing pipe; one side of the feeding drive block 1 is provided with the support, and the support is further provided with the positioning assembly 5; the fracturing pipe is disposed through the positioning assembly, and the fracturing pipe may be disposed for a fine adjustment angle in the positioning assembly.

The positioning assembly includes a positioning shoulder seat 24, a positioning sleeve 25, a ball hinge 23, a connecting member 22, and a sleeve card 21, wherein the positioning shoulder seat is fixed on the support, the positioning sleeve is sleeved on the positioning shoulder seat, and the positioning sleeve is provided inside with a through hole; an end of the positioning sleeve is further connected with the ball hinge capable of finely adjusting the angle, the ball hinge is also provided with the through hole, and an end face of the ball hinge is connected to the sleeve card by the connecting member.

The sealing liquid is a quick-setting expansion sealing slurry, and the fracturing pipe is provided inside with a fracturing liquid supply hole or the fracturing pipe adopts an automatically controlled liquid-phase carbon dioxide fracturing device.

In the disclosure, by controlling the fracturing of fracturing pipes and the sealing of a segmented sealing mechanism for fracturing using a fracturing controller, the fracturing in fracturing holes can be effectively controlled. The segmented sealing mechanism for fracturing in the disclosure can separate each of the fracturing pipes in the fracturing holes separately in a sealed manner respectively, and perform segmented fracturing operations using each of the fracturing pipes, so as to effectively improve the uniformity and thoroughness of fracturing and ensure fracturing ability. In the disclosure, when the sealing operations are performed in each segment, the sealing effect of each segment can be ensured, and the sealing efficiency can be ensured, so that the fracturing ability of each segment of fracturing is improved to ensure the fracturing effect.

What is mentioned above is only the specific implementation of the present invention, but does not limit the protection scope of the present invention, and any equivalent replacements or changes made by those skilled in the art in the technical scope disclosed by the present disclosure within the technical scope disclosed by the present disclosure shall be covered by the protection scope of the present disclosure.

We claim:

1. A fracturing device for extraction of coalbed methane in low permeability reservoir, comprising a feeding mechanism for fracturing pipe, a plurality of fracturing pipes (7), a plurality of segmented sealing mechanisms for fracturing (6) and a fracturing controller, wherein the fracturing pipes (7) are fixed coaxially by using the segmented sealing mechanisms for fracturing (6), the feeding mechanism for fracturing pipe feeds each of the fracturing pipes (7) into fracturing holes of the coalbed methane, and the fracturing controller may control the fracturing of the fracturing pipes (7) and the sealing of the segmented sealing mechanisms for fracturing (6) so as to control the fracturing in the fracturing holes, and wherein the segmented sealing mechanisms for fracturing (6) separate each of the fracturing pipes (7) in the fracturing holes separately in a sealed manner respectively so as to perform segmented fracturing operations using each of the fracturing pipes;

wherein each of the segmented sealing mechanisms for fracturing (6) comprises a front sealing seat (8), a rear sealing seat (9), a front expansion sealing ring (10) and a rear expansion sealing ring (16), wherein the front sealing seat (8) is coaxially fixedly connected to the rear sealing seat (9), and ends of the front sealing seat (8) and the rear sealing seat (9) are connected to the respective fracturing pipe (7); both the front sealing seat (8) and the rear sealing seat (9) are provided with a reception annular groove, the reception annular groove of the front sealing seat (8) is sleeved inside with the front expansion sealing ring (10), the reception annular groove of the rear sealing seat (9) is sleeved inside with the rear expansion sealing ring (16), and expansions of the front expansion sealing ring (10) and the rear expansion sealing ring (16) are controlled by the fracturing controller.

2. The fracturing device for extraction of coalbed methane in low permeability reservoir according to claim 1, wherein before the front expansion sealing ring (10) and the rear expansion sealing ring (16) do not expand, outer peripheral surfaces of the front expansion sealing ring (10) and the rear expansion sealing ring (16) are lower than a notch surface of the reception annular groove, and after the front expansion sealing ring (10) and the rear expansion sealing ring (16) expand, the outer peripheral surfaces abut against inner walls of the fracturing holes.

3. The fracturing device for extraction of coalbed methane in low permeability reservoir according to claim 1, wherein a sealing fluid outflow hole (13) for a sealing fluid to flow out is disposed between the front expansion sealing ring (10) and the rear expansion sealing ring (16), the sealing fluid outflow hole (13) is arranged on the front sealing seat (8) and/or the rear sealing seat (9), and a sealing fluid outflow hole (13) is provided inside with a pressure valve; the pressure valve is configured such that the pressure valve allows the sealing fluid to outflow into a sealing cavity (20) surrounded by the front expansion sealing ring (10), the rear expansion sealing ring (16) and the inner walls of the fracturing holes only when the sealing fluid in the sealing fluid outflow hole (13) reaches a certain pressure value.

4. The fracturing device for extraction of coalbed methane in low permeability reservoir according to claim 3, wherein the pressure value is configured such that the pressure valve allows the sealing fluid to outflow into the sealing cavity (20) surrounded by the front expansion sealing ring (10), the rear expansion sealing ring (16) and the inner walls of the fracturing holes only when the front expansion sealing ring (10) and the rear expansion sealing ring (16) expand to a certain degree.

5. The fracturing device for extraction of coalbed methane in low permeability reservoir according to claim 3, wherein the front sealing seat (8) is welded to the rear sealing seat (9), and a cavity (14) is disposed where the front sealing seat is welded to the rear sealing seat; the front sealing sea (8) and the rear sealing seat (9) are provided with sealing controlling holes (18) arranged coaxially and communicating with the front expansion sealing ring (10) and the rear expansion sealing ring (16), respectively, and the front expansion sealing ring (10) and the rear expansion sealing ring (16) communicate with the cavity through a communication channel (12), respectively, so that the sealing liquid sequentially flow from the sealing controlling holes (18) to the front expansion sealing ring (10), the communication channel (12), the cavity, the communication channel (12) and the rear expansion sealing ring (16), and outflowed by the sealing controlling holes (18) at the rear expansion sealing ring (16).

6. The fracturing device for extraction of coalbed methane in low permeability reservoir according to claim 5, wherein the sealing controlling holes (18) are connected with communication pipes (17), and centers between the front sealing seat (8) and the rear sealing seat (9) are also connected by a connecting post (15); an end of the connecting post is limited on a connecting ring in the cavity by a limiting member (11), and the connecting ring is provided axially with an axial communication hole (19); the sealing liquid outflow hole (13) is communicated to the cavity (14) and extends in a radial direction along the front sealing seat (8) or the rear sealing seat (9).

7. The fracturing device for extraction of coalbed methane in low permeability reservoir according to claim 1, wherein the feeding mechanism for fracturing pipe comprises a feeding drive block (1), a support (2), a feeding post (3), and a positioning assembly (5), wherein an output end of the feeding drive block (1) is connected to the feeding post, and a lower end of the feeding post is tightly connected to the fracturing pipe; one side of the feeding drive block (1) is provided with the support, and the support is further provided with the positioning assembly (5); the fracturing pipe is disposed through the positioning assembly, and the fracturing pipe is disposed for a fine adjustment angle in the positioning assembly.

8. The fracturing device for extraction of coalbed methane in low permeability reservoir according to claim 7, wherein the positioning assembly comprises a positioning shoulder seat (24), a positioning sleeve (25), a ball hinge (23), a connecting member (22), and a sleeve card (21), wherein the positioning shoulder seat is fixed on the support, the positioning sleeve is sleeved on the positioning shoulder seat, and the positioning sleeve is provided inside with a through hole; an end of the positioning sleeve is further connected with the ball hinge capable of finely adjusting the angle, the ball hinge is also provided with the through hole, and an end face of the ball hinge is connected to the sleeve card by the connecting member.

9. The fracturing device for extraction of coalbed methane in low permeability reservoir according to claim 8, wherein the sealing liquid is a quick-setting expansion sealing slurry, and the fracturing pipe is provided inside with a fracturing liquid supply hole or the fracturing pipe adopts an automatically controlled liquid-phase carbon dioxide fracturing device.

* * * * *